US005978613A

United States Patent [19]

Mendisch et al.

[11] Patent Number: 5,978,613

[45] Date of Patent: Nov. 2, 1999

[54] DEVICE FOR MONITORING THE OPERATION OF A FIXING STATION OF AN ELECTROGRAPHIC PRINTING DEVICE

[75] Inventors: Norbert Mendisch, München; Franz Hintler, Aschau; Gerhard Lödermann, München, all of Germany

[73] Assignee: Oce Printing Systems GmbH, Poing, Germany

[21] Appl. No.: 09/065,070

[22] PCT Filed: Jul. 15, 1996

[86] PCT No.: PCT/DE96/01281

§ 371 Date: Sep. 24, 1998

§ 102(e) Date: Sep. 24, 1998

[87] PCT Pub. No.: WO97/15870

PCT Pub. Date: May 1, 1997

[30] Foreign Application Priority Data

Oct. 25, 1995 [DE] Germany ..... 195 39 697

[51] Int. Cl.[6] ..... G03G 15/00

[52] U.S. Cl. ..... 399/18; 226/24; 271/258.01; 399/22; 399/68

[58] Field of Search ..... 399/18, 21, 22, 399/68, 322, 323, 384, 397, 400; 226/11, 24, 45; 271/258.01

[56] References Cited

U.S. PATENT DOCUMENTS 5,063,845 11/1991 Perretta ..... 226/11

FOREIGN PATENT DOCUMENTS 0 363 686 4/1990 European Pat. Off. .
0 583 928 2/1994 European Pat. Off. .

OTHER PUBLICATIONS

Japanese Abstract, JP2042471, Feb. 13, 1990, vol.14, No. 201.

Japanese Abstract, JP55021334, Feb. 15, 1980, vol. 4, No. 53.

Japanese Abstract, JP62085268, Apr. 18, 1987, vol. 11, No. 291.

*Primary Examiner*—Matthew S. Smith
*Assistant Examiner*—William A. Noe
*Attorney, Agent, or Firm*—Hill & Simpson

[57] ABSTRACT

An apparatus is provided in a printer to prevent wrapping of the paper web onto the printer's fixing roller which fixes the toner particles onto the paper web. The apparatus includes a sensor to monitor the speed and moving direction of the web at the output of the fixing station. The sensor is connected to a controller which operates to halt the operation of the fixing station or the printer when the sensor senses a reversal of the moving direction of the web. The controller may average the web moving speed and compare the average speed to a predetermined speed for halting printer operation if the average speed traverses the predetermined speed.

9 Claims, 4 Drawing Sheets

DEVICE FOR MONITORING THE OPERATION OF A FIXING STATION OF AN ELECTROGRAPHIC PRINTING DEVICE

BACKGROUND OF THE INVENTION

1. Field of the Invention

The present invention is directed to a means for monitoring the operation of a fixing station of an electrographic printer that prints a web of continuous carrier material with a toner image containing color particles.

2. Description of the Related Art

High dependability demands must be met in the operation of a fixing station since, for example, one of the fixing rollers contained in the fixing station is heated to approximately 220° C., and the carrier material conveyed through the fixing station can stick to the hot fixing roller. Given high conveying speeds of the carrier web, the fixing rollers turn very fast. When the sticking of the carrier material to the hot fixing roller is not noticed, then the carrier material being fixed at the moment wraps around the hot fixing roller, whereby carrier material that has already passed the fixing station can be drawn back into the fixing station opposite the conveying direction.

Given the use of continuous carrier material that has fold lines so that it can be drawn sheet-by-sheet from a stack or in turn folded sheet-by-sheet onto a stack after being printed (such as fan folded paper), the stiffness of the carrier material is greatly reduced along the fold lines. It is precisely at such fold lines that the carrier material easily sticks to the hot fixing roller during the fixing process, as is shown in practice. The fold lines are often the cause for the wrapping of the fixing roller. When the wrapping of the fixing roller is not noticed early on, then an increased work outlay is incurred given operation of the printer since printing must be interrupted, the carrier material must be removed from the fixing roller, one must wait for the printer to be operational again and the print operation that has already been carried out may possibly have to be repeated.

SUMMARY OF THE INVENTION

An object of the present invention is to provide a means for monitoring the operation of the fixing station that allows the sticking of the carrier material to the hot fixing roller to be recognized early.

The present invention offers a means for monitoring the operation of a fixing station of an electrographic printer that prints a web of continuous carrier material with a toner image containing color particles, whereby the web is conveyed through the fixing station with a predetermined transport speed, the fixing rollers of the fixing station fixing the color particles on the web, whereby the web that is conveyed out of the fixing station is sensed by a sensor unit that acquires, or measures, the actual speed of the web, and whereby a controller compares the actual speed to the predetermined transport speed and generates a signal about the operating condition of the fixing station that is dependent on the comparison.

The actual speed of the web following the fixing station is acquired, or measured, by sensing the web conveyed from the fixing station using a sensor unit. The deviations in speed arising due to the sticking and possible release of the carrier material from the hot fixing roller by itself are contained in the actual speed acquired by the sensor unit. When the actual speed is compared to the predetermined transport speed with the assistance of a controller, for example a microprocessor controller, then these deviations can be identified. Since adhesion of the web to the hot fixing roller cannot be completely avoided, a signal about the operating condition that signals a malfunction is first generated when a specific speed deviation is transgressed. For example, such a signal can be employed to interrupt the fixing process or, respectively, the printing process.

One embodiment of the invention provides that the sensor unit contains a wheel for sensing the web that is connected to a shaft encoder that acquires the actual speed. The speed of the web can be sensed with a high precision with a wheel having non-positive contact with the web that expediently has a high coefficient of friction. The rotary motion of the wheel is converted into an electrical signal with the assistance of a shaft encoder, whereby a predetermined number of electrical signals is output or generated per revolution of the wheel, being output to a sensor attached in the environment of the wheel by the wheel itself or by sensor elements attached thereto.

A development of the aforementioned embodiment is comprised therein that, given a foldable web, the wheel is fashioned as an impeller wheel whose blades are turned by sheets folding onto a stack. By using an impeller wheel, the folding of the web onto a stack sheet-by-sheet can be monitored with little technical outlay.

A preferred embodiment of the invention provides that the shaft encoder contains a gear wheel composed of a magnetic material whose gears are successively conducted passed two magnetic sensors spaced from one another whose output signals image the actual speed. The imaging of the rotary motion into electrical signals with the assistance of magnetic sensors represents a simple and nonetheless rugged mensurational solution. A gear wheel is employed whose teeth serve as sensor elements and cause an output signal when moving passed the respective magnetic sensor. The number of output signals within a time unit is directly dependent on the rotational speed of the gear wheel that is in turn prescribed by the actual speed of the web. In the simplest case, a coil can be employed as the magnetic sensor.

When the spacing of the sensor is smaller than half the spacing of two neighboring teeth, then a reverse of the conveying direction of the web following the fixing station can be recognized in a simple way with the assistance of the output signals in addition to the actual speed. Given this spacing, for example, output signals due to the very same tooth simultaneously arise at both sensors given specific gear wheel positions. When the gear wheel continues to turn, then the appertaining tooth causes an output signal only at a first of the sensors. The other sensor outputs no output signal and must thus be arranged following the first sensor in the rotational direction of the gear wheel. The rotation direction of the gear wheel can be identified using the predetermined arrangement of the sensors following the reversing of the gear wheel direction. The rotational sense of the gear wheel can thus be determined by comparing the time sequence of the two output signals.

Another exemplary embodiment of the invention provides that the controller contains an electrical signal for generating an error signal given a reverse of the conveying direction, this electrical circuit having its input side connected to the sensor unit. When a reversal of the conveying direction occurs, then the hot fixing roller should not continue to rotate since, as already mentioned, carrier material that has already had the image fixed thereon wraps around the hot fixing roller. It is thus important to interrupt the fixing process as quickly as possible. In order to quickly acquire the rotational sense of the gear wheel, which changes when the web conveying direction reverses, the comparison of the time sequence of the sensor signals must likewise be implemented fast. The error signal signaling the reversal of rotational sense can be generated quickly by utilizing an electrical circuit. When one employs the above-described magnetic sensors and their respective output signals, then the electrical circuit can be simply implemented in that the error signal is generated at an output of a D-flipflop whose clock input is driven by one of the output signals and whose signal input is driven by the other output signal. Such a circuit can be simply and inexpensively realized with few additional components.

A preferred embodiment of the invention provides that, given deviation of the actual speed from the predetermined transport speed by a predetermined amount, the controller arrests, or halts, the operation of the fixing station or, of the printer. By stopping the operation of the fixing station it is possible to limit the damage due to the sticking of the carrier material since only a small part of the carrier material sticks to the hot fixing roller if stopped in time, thereby making it easier to eliminate manually than after a multiple wrapping of the hot fixing roller with carrier material.

A further preferred embodiment provides that the controller averages the actual speed within a predetermined time window, and the average actual speed is utilized for the comparison with the transport speed. It is thus assured that the fixing process is only interrupted when the sticking of the carrier material to the hot fixing roller exceeds a critical value. A slight sticking of the carrier material to the hot fixing roller cannot be completely avoided and is also innocuous when an automatic release thereof from the hot fixing roller occurs due to the tension of the carrier material. By averaging over a number of actual speeds which differ due to sticking before preforming the comparison to the predetermined transport speed, the operation of the fixing station is not interrupted at every slight sticking of carrier material to the hot fixing roller, so that continuous operation is possible.

BRIEF DESCRIPTION OF THE DRAWINGS

An exemplary embodiment with further expedient developments of the invention is explained below with reference to the drawings.

DETAILED DESCRIPTION OF THE PREFERRED EMBODIMENTS

Figure 1:
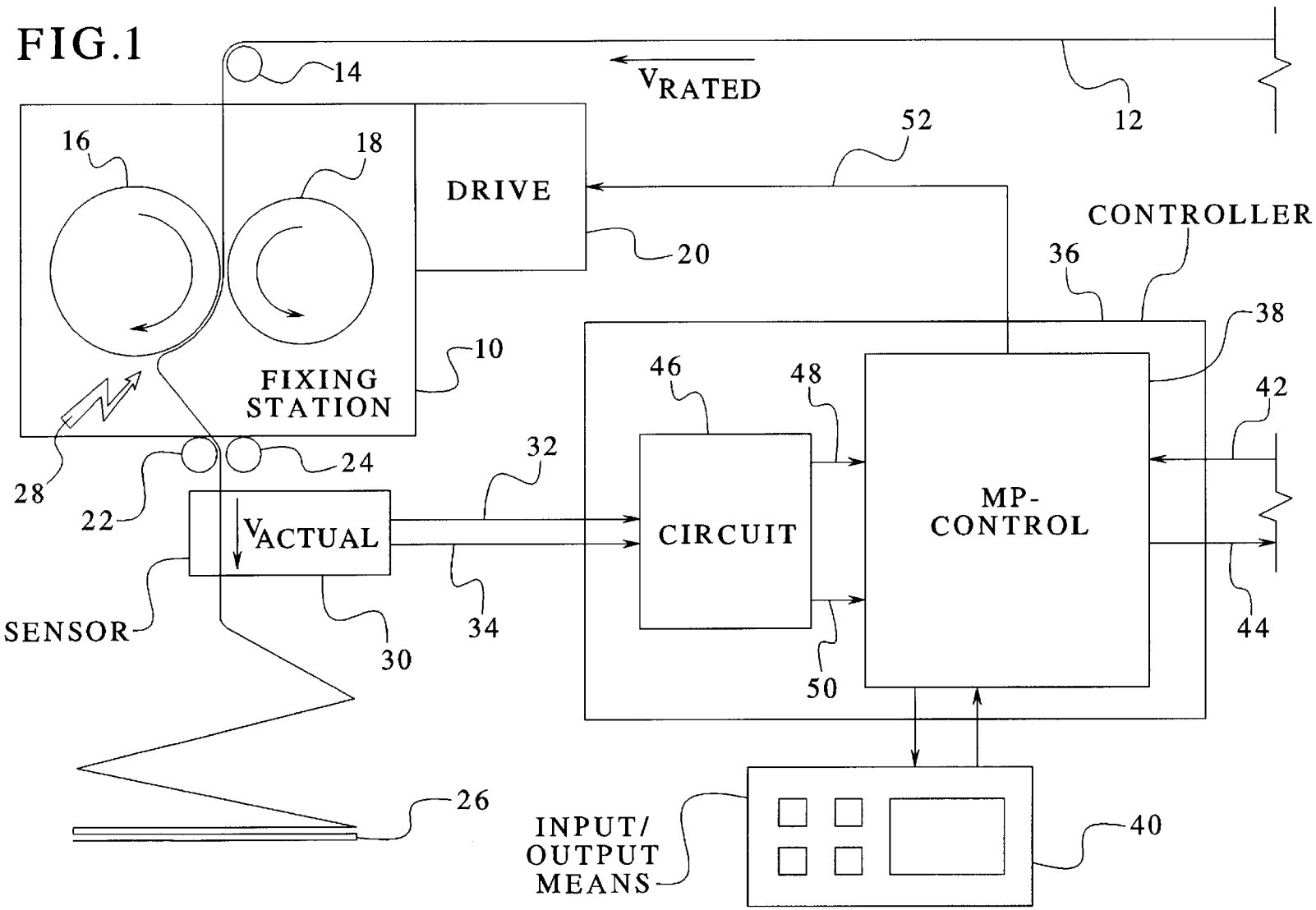
FIG. 1 is a schematic illustration of a means for monitoring the operation of a fixing station.

FIG. 1 shows a schematic illustration of a means for monitoring the operation of a fixing station 10. The fixing station 10 is a component part of an electrographic printer that prints a web 12 of continuous carrier material. The web 12 is supplied to the fixing station 10 with a predetermined transport velocity $V_{rated}$ via a deflection roller 14 arranged transversely relative to the conveying direction, being supplied by a conveyor means that is not shown.

The fixing station contains a heated fixing roller 16 for fixing a toner image situated on the web. The fixing roller 16 rotates in the direction indicated by a rotational sense arrow. The fixing roller 16 has a cooperating pressure roller 18 allocated to it whose rotational sense is likewise indicated with a rotational sense arrow. In the fixing process, the web 12 is conducted between the fixing roller 16 and the cooperating pressure roller 18 lying directly there against. Since the surface of the fixing roller 16 is at a temperature of approximately 220° C., the toner image is fused into the carrier material of the web 12 and thus fixed. The fixing roller 16 and the cooperating pressure roller 18 are driven with the assistance of a drive 20.

After leaving the fixing station 10, the web 12 passes two guide rollers 22 and 24 lying opposite one another transversely relative to the conveying direction with an actual velocity $V_{actual}$. The web is folded onto a stack 26 after the fixing process.

The actual velocity $V_{actual}$ can deviate from the predetermined transport velocity $V_{rated}$ when a disturbance 28 occurs during the fixing process in the fixing station 10. For example, the disturbance 28 arises in that the web 12 sticks to the hot fixing roller 16. When the stiffness of the web 12 is great enough, then the web 12 automatically releases from the fixing roller 16 after a few millimeters and the disturbance 28 has a relatively low value. The stiffness of the web 12 is greatly reduced in the environment of fold lines given a foldable web 12. The disturbance can achieve extremely high values at these locations during the fixing process since the web 12 releases late from the fixing roller 16. In the extreme case, the web 12 does not release from the fixing roller 16, so that the web 12 wraps around the fixing roller 16. When this occurs, then the stack 26 that has already been fixed begins to unfold. While reversing the conveying direction, the web 12 is pulled into the fixing station 10 from the stack 26.

For determining the actual velocity $V_{actual}$, a sensor unit 30 sensing the web 12 is attached following the fixing station 10, this sensor unit 30 outputting sensor signals 32 and 34. The mechanical quantity of the actual velocity $V_{actual}$ is imaged into electrical signals with the assistance of the sensor unit 30. The structure of the sensor unit 30 is explained later with reference to FIG. 2.

The sensor signals 32 and 34 are supplied to a controller 36. The controller 36 contains a microprocessor control 38 for the control of the printer. The microprocessor control 38 is connected to an input/output means 40 with whose assistance demands can be input and to which the microprocessor control 38 can output signals indicating the operating condition of the printer. The microprocessor control 38 receives input signals 42 from other sensor units (not shown) within the printer and has outputs 44 for the drive of actuators (not shown) within the printer.

Further, the controller 36 contains a circuit 46 for the evaluation of the sensor signals 32 and 34 that generates an error signal 48 as well as a velocity signal 50. The principle of the circuit 46 is explained later with reference to FIG. 3. The error signal 48 signals a reversal of the conveying direction of the web 12 that has already been fixed and leads to the immediate interruption of the fixing process. To that end, it is, supplied to the microprocessor control 38 via a separate input. This input is expediently an interrupt input interrogated with priority by the microprocessor.

The velocity signal 50 is evaluated by the microprocessor control 38 with the assistance of a program. It is thereby advantageous when not all fluctuations in the velocity signal 50 lead to a reaction of the microprocessor control 38; rather, an average is formed over a plurality of velocity signals 50.

Given the occurrence of an error signal 48 or given excessively great fluctuations of the velocity signal 50, the microprocessor control 38 reacts in that the drive 20 of the fixing station 10 is shut off with the assistance of an interrupt signal 52.

Figure 2:
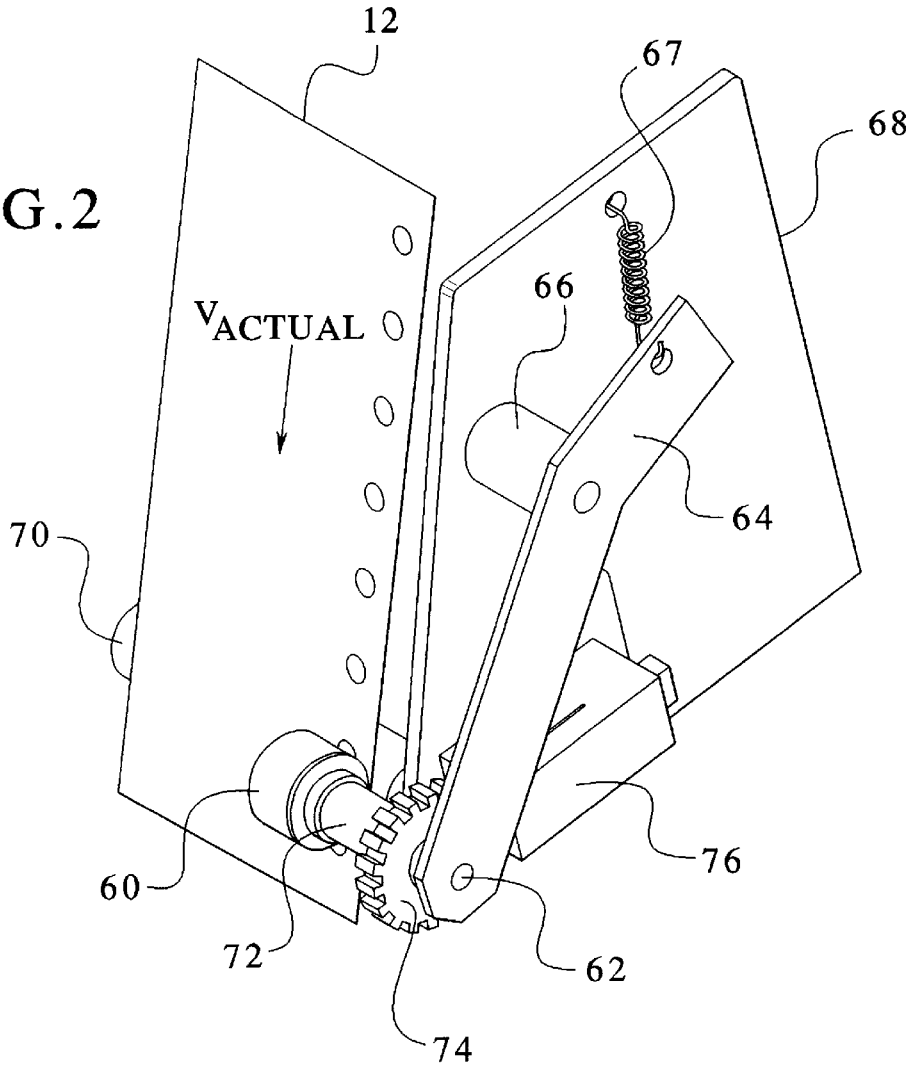
FIG. 2 is a perspective view of a sensor unit for sensing the web.

FIG. 2 shows a view of the sensor unit 30 for sensing the web 12. A friction wheel 60 is in non-positive contact (frictional contact as opposed to toothed engagement of perforations) with the edge of the web 12, so that its rotational speed is directly related to the actual velocity $V_{actual}$ of the web 12. The friction wheel 60 is characterized by a high coefficient of friction at its surface that increases the non-positive lock with the web 12. The sensing of the web 12 at its edge assures that the newly fixed toner image is not deteriorated by the sensing process. When the web 12 is also perforated, then the perforations increase the friction engagement of the friction wheel 60 with the web 12.

The friction wheel 60 is rotatably seated on an axle 62 that is secured to a first end of a retainer element 64. The retainer element 64 is rotatably seated at a spacer 66 that is secured to a frame 68. The non-positive engagement of the friction wheel 60 with the edge of the web 12 is increased by a spring force of a spring 67 at the other end of the retainer element 64. In order to further increase the non-positive engagement, a guide roller 70 is attached to the frame 68 transversely relative to the conveying direction of the web 12 in such a way that the guide roller 70 simultaneously serves as a cooperating pressure roller for the friction wheel 60.

The friction wheel 60 is torsionally connected to a hollow shaft 72. A gear wheel 74 that influences a magnetic field is torsionally connected to the hollow shaft 72, so that the friction wheel 60, the hollow shaft 72 and the gear wheel 74 form a unit. The unit 60, 72 and 74 is rotatably seated on the axle 62 and has the function of a shaft encoder which also includes a sensor assembly 76.

Figure 3:
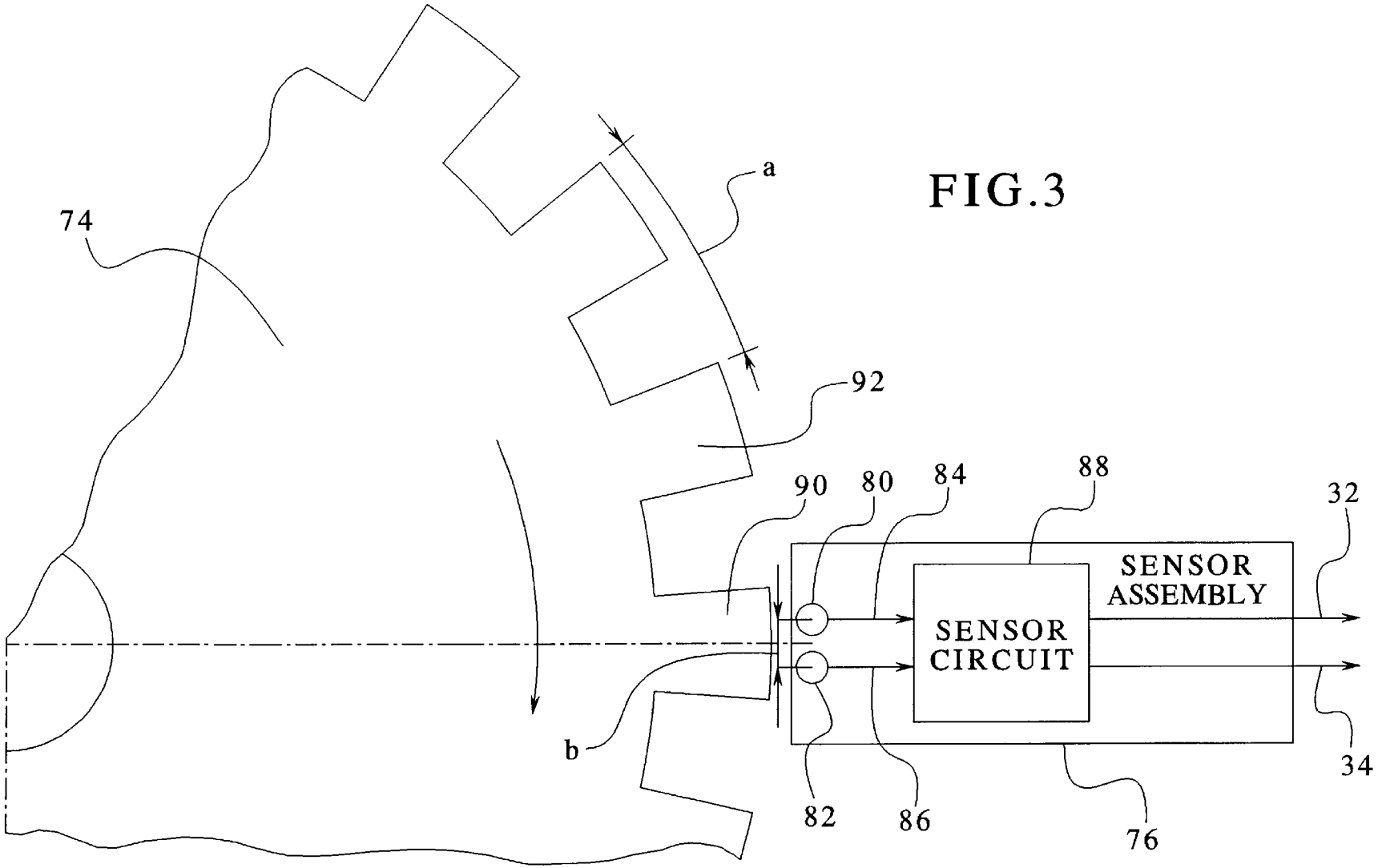
FIG. 3 is an enlarged side view of an arrangement of sensors within a sensor assembly.

FIG. 3 shows an arrangement of sensors 80 and 82 within the sensor assembly 76. The teeth of the gear wheel 74 have an identical tooth spacing a from one another. The sensor assembly 76 contains two magnetic sensors 80 and 82 that vary their electrical behavior, for example their value of current or voltage, when the teeth of the gear wheel 74 rotate past. For example, magneto-resistive sensors that vary their resistance under the influence of a changing magnetic field can be employed as the magnetic sensors 80 and 82. The change in magnetic field is effected by the approach of a tooth of the gear wheel 74. The two sensors 80 and 82 have the sensor spacing b in the rotational sense of the gear wheel 74. The change of the voltage values is acquired in a sensor circuit 88 via the lines 84 and 86. The sensor circuit 88 amplifies the changes in voltage or current and outputs square-wave sensor signals 32 and 34.

When the sensor spacing b is smaller than half the tooth spacing a/2 then the rotational sense of the gear wheel 74 can be determined by comparing the sensor signals 32 and 34. The determination of the rotational sense shall be explained below with reference to two teeth 90 and 92 in conjunction with FIGS. 5*a* and 5*b*.

Figure 4:
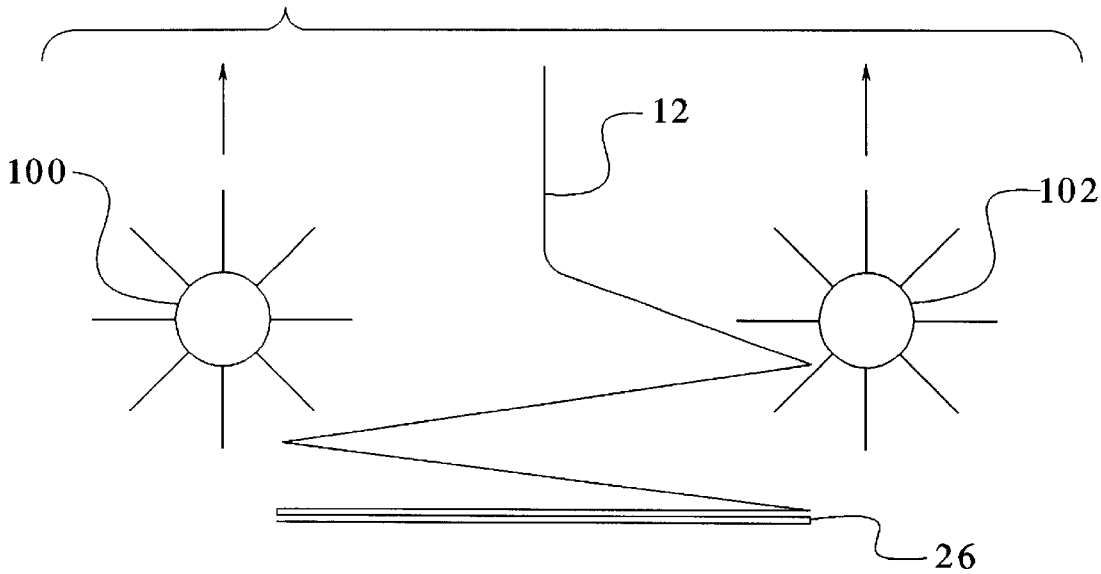
FIG. 4 is a schematic illustration of an arrangement of impeller wheels for monitoring the folding of the web.

FIG. 4 shows an arrangement of impeller wheel 100 and 102 for monitoring the folding of the web 12. After the fixing process, the web 12 is folded up onto the stack 26, as already mentioned. The folding of the web occurs along fold points or lines that respectively limit a sheet of the stack 26 in the transport direction, occurring under the influence of the force of the weight of the web 12. Since the impeller wheels 100 and 102 are seated to be easily rotatable and are in engagement with the web 12 in the way shown in FIG. 4, they are placed into rotation by the force of the weight of the sheets of the web 12 folding onto the stack 26. The impeller wheels 100, 100 and 102 are respectively combined with an arrangement composed of a hollow shaft 72, a gear wheel 74 and a sensor assembly 76, so that the sensor signals 32 and 34 in conformity with the rotational sense of the impeller wheels 100 and 102 can be generated. When the stack 26 has grown to such a height that at least one of the impeller wheels 100 and 102 can no longer turn since a rotational motion is prevented by the uppermost sheet of the sheet stack 26, then the impeller wheels 100 and 102 are lifted in the direction of the illustrated vertical arrows with the assistance of a guide (not shown) until a rotational motion is again possible. When the afore-mentioned reversal of the conveying direction occurs, then the impeller wheels 100 and 102 rotate in the opposite direction. In this case, the fixing process, is immediately interrupted by the controller.

Figure 5B:
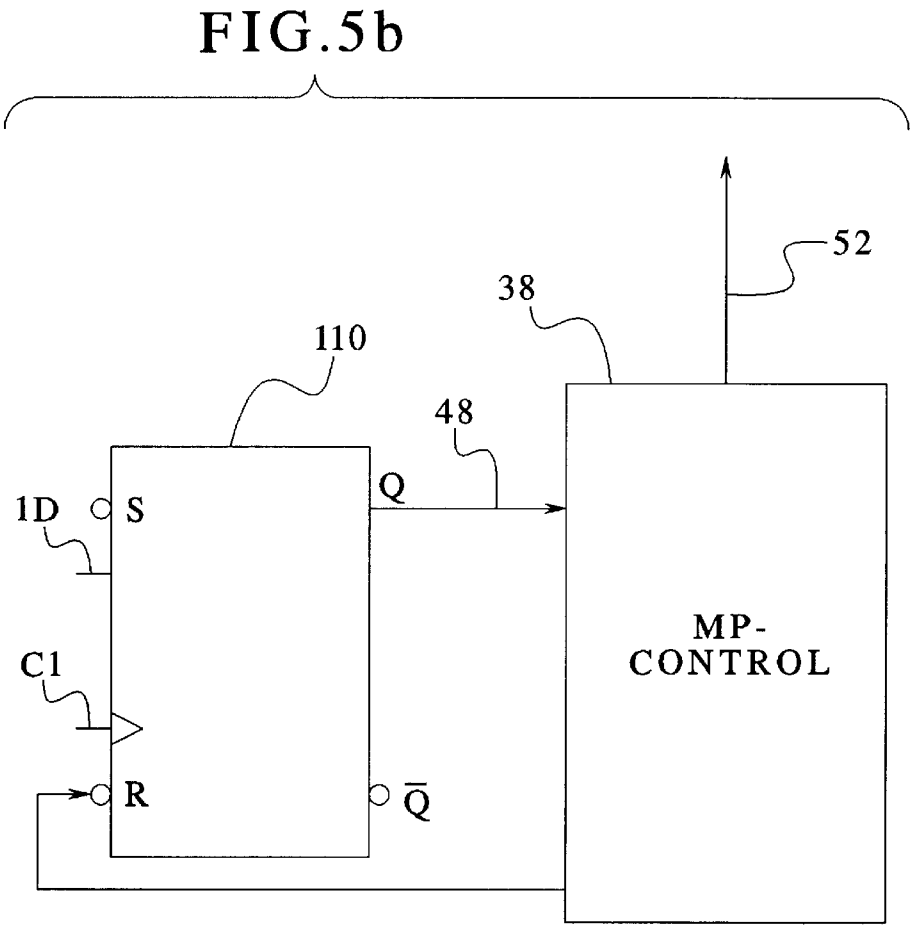
FIGS. 5*a* and 5*b* are a signal diagram and an electrical circuit for generating an error signal from the sensor signals of the sensor unit.
Figure 5A:
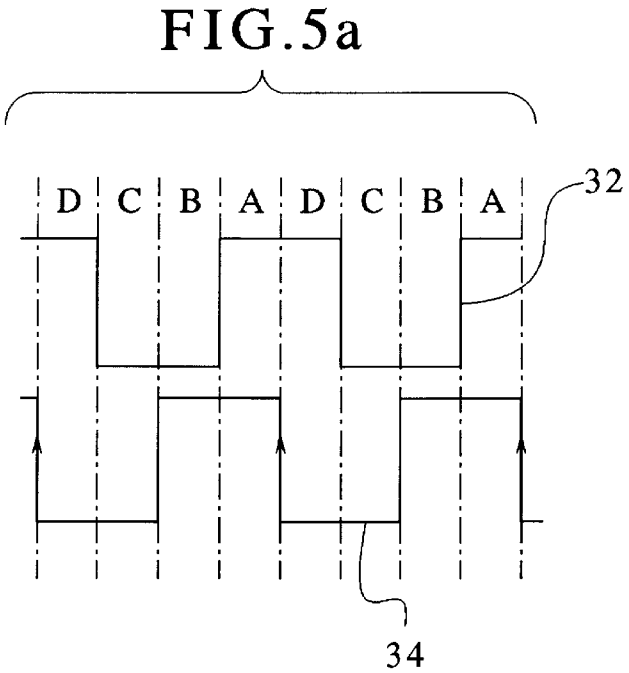

FIG. 5*a* shows the principle of the circuit 46 for generating an error signal from the sensor signals 32 and 34. The sensor signals 32 and 34 have a square-wave voltage curve, as can be derived from FIG. 5*a*. This voltage curve results from the approximately parallel flanks of the teeth of the gear wheel 74 and from signal editing in the sensor circuit 88. A phase shift of approximately 90° occurs between the two sensor signals 32 and 34, this resulting from the sensor spacing b=a/2, whereby the sensor signal 32 or, respectively, 34 is allocated to the sensor 80 or, respectively, 82. The four signal states A–D repeat in the pulse curve of the sensor signals 32 and 34 according to FIG. 5*a,* with increasing time shown directed to the left.

The signal state A corresponds to the position of the gear wheel 74 shown in FIG. 3. The tooth 90 causes a corresponding change of the electrical voltage at both sensors 80 and 82, this being expressed in a high voltage value of the sensor signals 32 and 34. When the gear wheel 74 turns in the direction indicated in FIG. 3 by the rotational sense arrow by the value a/4 at its circumference, then the sensor 80 is no longer influenced by the tooth 90, so that the voltage of the sensor 80 has a quiescent value. The state B is thus reached in which the sensor signal 32 has a low voltage value and the sensor signal 34 has a high voltage value. After further rotation of the gear wheel 74 by the value a/4 in the circumferential direction, the signal state C derives wherein both sensor signals 32 and 34 have a low voltage value since neither of the sensors 80 or 82 is influenced by a tooth. After another rotation of the gear wheel 74 by the value a/4, the signal state D derives wherein the sensor 80 is influenced by the tooth 92. As a result thereof, the sensor signal 32 has a high voltage value; the sensor 82 is not influenced by a tooth, the sensor signal thus having a low voltage value. Given further rotation of the gear wheel 74 in the rotational sense shown in FIG. 3, the states A–D reoccur in their alphabetical sequence. In other words, the sensor signal 32 leads the sensor signal 34 by 90°.

The two sensor signals 32 and 34 are supplied to a single-edge control D-flipflop 100 as shown in FIG. 5*b*. The sensor signal 32 drives the signal input 1D of the D-flipflop 110. The sensor signal 34 is supplied to the clock input C1. Circuit-oriented details such as, for example, the wiring of the input S for setting the D-flipflop 110 in a specific condition and of the output $\overline{Q}$ are not shown in FIG. 5*b* since they are at the command of a person skilled in the art. This is also true of electrical protective measures and of a potential electrical improvement of the sensors 32 and 34 such as, for example, an enhancement of the edge steepness.

The D-flipflop can be set into a defined initial condition by the microprocessor control 36 via the reset input R. The output Q of the D-flipflop 110 is directly interpreted by the microprocessor control since the error signal 48 is adjacent thereat.

Given a voltage curve of the sensor signals 32 and 34 as shown in FIG. 5, the high voltage value of the sensor signal 32 at this time is stored in the D-flipflop 110 with every leading edge of the sensor signal 34 and is output at the output Q, so that this likewise has a high voltage value. When a reverse of the conveying direction occurs in case of error, then the sensor signal 32 trails the sensor signal 34 by 90°. The inverted sensor signal 32 shown in FIG. 5 is equivalent. The voltage value of the sensor signal 32, which is low until the rise of the edge, is thus stored in the D-flipflop 110 at every leading edge of the sensor signal 34 and is output at its output Q. In case of error, accordingly, the output Q will have a low voltage value. The low voltage value of the error signal 48 is recognized as an error by the microprocessor control 38, so that the interrupt signal 52 for interrupting the drive 20 of the fixing station 10 is generated.

The sensor signals 32 and 34 can be supplied directly to the microprocessor control as a velocity signal 50. In order, however, to relieve the microprocessor control 38, it is advantageous to supplement the circuit according to FIG. 5 with a XOR gate at whose one input the sensor signal 32 pends and at whose other input the sensor 34 pends. A single signal that combines the velocity information of the sensor signals 32 and 34 since it has a frequency that is twice as high as one of the sensor signals 32 or, respectively 34 arises at the output of the XOR gate. The output signal of the XOR gate is then supplied to the microprocessor control as a velocity signal 50.

Although other modifications and changes may be suggested by those skilled in the art, it is the intention of the inventors to embody within the patent warranted hereon all changes and modifications as reasonably and properly come within the scope of their contribution to the art.

We claim:

1. An apparatus for monitoring operation of a fixing station of an electrophotographic printer that prints a web of continuous carrier material with a toner image containing color particles, the web being conveyed through a fixing station with a predetermined transport velocity, fixing rollers in the fixing station fixing the color particles on the web; comprising:

a sensor unit mounted to sense the web as it is conveyed out of the fixing station so that said sensor unit acquires an actual velocity and a transport direction of the web and outputs a signal representing the actual velocity and the transport direction; and a controller connected to said sensor unit to compare the signal representing the actual velocity to a predetermined transport velocity and to compare the transport direction to a predetermined transport direction, said controller generating a signal indicating an operating condition of the fixing station dependent on the comparison, said controller having an output connected to interrupt operation of the fixing station given a reverse in the transport direction.

2. An apparatus according to claim 1, wherein said sensor unit includes a wheel mounted for sensing the web, and a shaft encoder connected to said wheel that acquires the actual velocity.

3. An apparatus according to claim 2, wherein the web is a foldable web said wheel being an impeller wheel whose blades are turned by sheets folding onto a stack.

4. An apparatus according to claim 2, wherein said shaft encoder includes a gear wheel composed of magnetic material having teeth successively conducted passed said sensor unit upon movement of the web, said sensor unit includes two magnetic sensors spaced from one another whose output signals represent the actual velocity.

5. An apparatus according to claim 4, wherein said two magnetic sensors are mounted at a spacing that is smaller than half a spacing of two neighboring ones of said teeth.

6. An apparatus according to claim 1, wherein said controller includes an electrical circuit whose input side is connected to said sensor unit for generating an error signal given reverse of the transport direction.

7. An apparatus according to claim 6, wherein said sensor unit generates first and second output signals, and wherein said electrical circuit is a D-flipflop having an output from which is emitted an error signal, said D-flipflop having a clock input connected to receive said first output signal and said D-flipflop having a signal input connected to receive said second output signal.

8. An apparatus according to claim 1, wherein said controller compares the actual velocity to the predetermined transport velocity and outputs a signal to arrest operation of the fixing station when the actual velocity exceeds the predetermined transport velocity by a predetermined amount.

9. An apparatus according to claim 8, wherein said controller includes means for averaging the actual velocity within a predetermined time window, and for comparing the average actual velocity to the transport velocity.

* * * * *